US005140708A

United States Patent [19]

Burns

[11] Patent Number: 5,140,708

[45] Date of Patent: Aug. 25, 1992

[54] SURGICAL GOWNS AND PASS CARDS THEREFOR

[75] Inventor: Barry E. Burns, Maineville, Ohio

[73] Assignee: Repack Surgical Enterpises, Inc., Cincinnati, Ohio

[21] Appl. No.: 493,211

[22] Filed: Mar. 10, 1990

[51] Int. Cl.[5] ..... A41D 13/00; A41D 13/12

[52] U.S. Cl. ..... 2/52; 2/46; 2/51; 2/114; 2/DIG. 7

[58] Field of Search ..... 2/46, 49 R, 51, 52, 2/105, 114, 106, DIG. 7

[56] References Cited

U.S. PATENT DOCUMENTS

| | | | |
|---|---|---|---|
| 2,148,152 | 2/1939 | Dosberg | 2/52 |
| 3,470,568 | 10/1969 | Belkin | 2/52 X |
| 3,754,284 | 8/1973 | Hartigan et al. | 2/338 X |
| 3,935,596 | 2/1976 | Allen, Jr. et al. | 2/114 |
| 3,977,025 | 8/1976 | Horan | 2/51 X |
| 4,016,604 | 4/1977 | Welke | 2/51 |
| 4,255,818 | 3/1981 | Crowley et al. | 2/51 |
| 4,290,148 | 9/1981 | Roberts | 2/51 |
| 4,326,300 | 4/1982 | Bolton et al. | 2/338 X |
| 4,369,527 | 1/1983 | Paul | 2/51 |
| 4,371,986 | 2/1983 | Wichman | 2/51 |
| 4,373,214 | 2/1983 | Wichman | 2/51 |
| 4,412,369 | 11/1983 | Carnaghi | 2/52 X |
| 4,451,931 | 6/1984 | Wichman | 2/51 |
| 4,457,024 | 7/1984 | Wichman | 2/51 |
| 4,558,468 | 12/1985 | Landry et al. | 2/114 X |

*Primary Examiner*—Werner H. Schroeder
*Assistant Examiner*—Jeanette E. Chapman
*Attorney, Agent, or Firm*—Kinney & Schenk

[57] ABSTRACT

A surgical gown fabricated of a light weight, woven polyester, is provided with side ties which permit it to be secured to a wearer in accordance with accepted sterile techniques. These ties are joined by a pass card having detachable locking means which engage the side ties and maintain them properly positioned when the gown is folded into a compact package and during the procedure of putting the gown on a wearer. When the gown is preliminarily secured to the wearer, by back ties, the wearer disengages one side tie from the pass card. An unsterile assistant then wraps the gown around the back of the wearer. The wearer then frees the other side tie from the pass card and joins the two side ties to secure the gown on his person. The configuration of the terminal ends of the side ties and the features of the pass card locking means facilitate the use of pass cards with reusable surgical gowns fabricated from woven fabrics.

24 Claims, 3 Drawing Sheets

SURGICAL GOWNS AND PASS CARDS THEREFOR

The present invention related to improvements in surgical gowns as they are packaged prior to being put on and further to an improved pass card which facilitates maintaining sterile conditions when the gown is put on.

It is of utmost importance that sterile conditions be maintained in a surgical operating arena. Among other precautions, persons entering the operating room are dressed in surgical gowns. The outer surfaces of these gowns are sterile, at least to the extent to which inadvertent contact might be had therewith. To obtain this end, there are accepted techniques, or protocols, for the manner in which the gowns are packaged and the procedure by which a gown is put on.

A surgical gown is in the nature of a wrap around garment having sleeves in which the arms of the wearer are first inserted. The upper portion of the garment is then wrapped around the neck of the wearer and secured by snaps so that the gown is draped over the shoulders of the wearer. The gown is preliminarily secured by back ties. A first back tie is attached to a side edge of the gown and a second back tie is attached to the rear surface of the gown, in spaced relation from the other side edge of the gown. An assistant secures the neck snap and ties the back ties.

The portion of the gown outwardly of the second back tie serves as a flap which is then wrapped around the wearer and lapped over the opposite side portion. The wrapped around garment is then secured by side ties disposed at the waist portion of the gown. A first side ties is secured to the side edge of the flap portion and the other side tie is secured to the front surface of the gown. The side ties are secured by the wearer who has disinfected his hands and is wearing sterile gloves. When a surgical gown is thus put on, its outer surface is sterile, excepting for the limited area at the back neck which has been contacted by the assistant in securing the snaps.

This points out that the accepted sterile technique presumes that a "sterile" person will not be available to assist the wearer in putting on the surgical gown.

The presumption that a sterile person will not be available to assist in putting on a surgical gown brings into focus the problem addressed by the present invention. More specifically, after the back ties are secured, folding of the flap portion around the back of the wearer and bringing the side tie thereon to his other side requires, in the usual case, the help of the assistant who is presumed to be unsterile. One means of attaining this end is for the assistant to grip the flap side tie with a sterile forceps, or similar sterile instrument, and, by this means, bring that side tie to a position where it can be gripped by the wearer and the two side ties joined.

Having thus identified the problem addressed by the present invention, other relative factors will next be discussed.

Surgical gowns are either of a disposable type or a reusable type. The disposable type is generally formed of a nonwoven sheet material in order that it may be economically discarded after a single use. The reusable type is generally formed of a woven fabric which is capable of being washed and then sterilized in a steam atmosphere. Surgical gowns fabricated from a thin, light weight, woven polyester fabric are a preferred by many surgeons. Such gowns are further characterized by a low coefficient of friction and are known as "slicks".

Surgical gowns are folded into a multi-layer, compact package, sterilized and then sealed in an envelope. In the folded gown package, the side ties are joined together and disposed across a "sterile field" which is disposed on the front of the wearer when the gown is put on and extends from his shoulders to his waist. In the folded gown package the "sterile field" and the side ties are disposed within and protected by the surface of the gown which will become the inner surface of the gown which will contact the person of the wearer.

Hitherto, the accepted practice has been to join the side ties of a reusable gown by knotting them together. In putting on the gown, the wearer unties this knot and an assistant employs sterile forceps, of the like, to pass the flap tie around the back of the wearer so that the side ties can be joined.

Packaged, disposable gowns have differed from reusable gowns in that the side ties of disposable gowns have been typically joined by a pass card. In putting on a disposable gown, the wearer disengages the side tie, secured to the front of the gown, from the pass card. The unsterile assistant then grips the pass card and employs it as the means for folding the flap portion around the back of the wearer. The wearer then pulls the flap side tie free from the pass card and joins it to the other side tie to secure the gown on his person.

Hitherto, the advantages of a pass card in putting on a reusable surgical gown have not be realized. This is to bring out the fact that pass cards designed for disposable gowns are not effective when it is attempted to use them with gowns fabricated of woven fabrics. This is particularly true of "slicks", i.e., gowns fabricated of light weight, woven polyester fabric, as indicated above. The specified problem is that side ties of this material do not have the stiffness and relatively high coefficient of friction found in the side ties of nonwoven fabrics found in disposable gowns. Thus the side ties of "slicks" are not effectively gripped by the pass cards as used with disposable gowns. When it is attempted to use such pass cards, one or both of the side ties will slip free and the desired ends of maintaining control to assure a sterile condition of the ties will be defeated.

Contributing to this problem is the necessity of steam sterilizing the folded gown package, after the side tie ends have been joined by a pass card. Thus, prior pass cards, even if effective in preventing inadvertent disengagement of the side ties before serialization, will lose that effectiveness after sterilization. It is to be noted that disposable gowns are capable of being sterilized in a dry gas atmosphere, so that the pass cards used therewith are not subject to the degrading effects of steam.

As noted, it is desired that the side ties be maintained in registration with the sterile filed up to the point that the pass card is disengaged from one side tie to permit the flap to be wrapped around the back of the wearer. In order to provide this end, the effective length of the ties, when secured to the pass card, is adjusted for a slender person of modest girth. In order that a tie will not be inadvertently disengaged from the pass card, it is desirable that means be provided for permitting an increase in the effective length of the ties, as the gown is preliminarily secured to a wearer having a relatively large girth.

The principle object of the present invention is to provide the advantages of a pass card to facilitate putting on reusable, surgical gowns formed of a light weight, woven fabric.

In furtherance of this object, it is a more specific object of the present invention to provide an improved pass card, an improved surgical gown characterized by side ties which cooperate with the improved pass card and an improved surgical gown package wherein such side ties are joined by the improved pass card.

These ends are attained by a surgical gown fabricated from a light weight, woven fabric, preferably having a low coefficient of friction and a polyester fabric. This gown has ties, formed of the same material, which are characterized by multiple layer, hemmed, terminal ends. Further, these ends are attained by a pass card which has means for detachably locking which are engagable with the ends of these side ties.

The pass card locking means are characterized by a slot, spaced inwardly from one end of the card. This slot has a width at least as great as the width of the ties and a length less than the thickness of the hemmed ends of the ties. This slot is adapted for the end of a side tie to be passed therethrough, thereby providing a locking action which requires a relatively strong pull to release.

The pass card locking means may also include a slit which is adapted to receive a loop formed in the side tie which is secured in the slot. A locking action is provided on this loop by deflection of the card material. The locking action on the loop requires a relatively small force to release the loop from the slit, but, nonetheless, is sufficient to prevent the loop from inadvertently coming loose from the pass card.

The pass card has a length sufficient for it to be gripped by both the wearer and assistant without contact between there hands. The pass card may thus be transferred to the assistant in accordance with accepted sterile techniques.

Other features are found in disposing the slit between the slot and an adjacent end of the card and in forming the slit so that it defines a tongue which overlies the loop in the tie. Further the slit may be sinuous to provide oppositely directed tabs underlying the loop in the side tie.

Preferably, locking means, characterized as above referenced, are provided at opposite ends of the card so that both side ties may be releasably locked thereon in the same fashion.

Other features of the invention are found in forming the pass card of a material which is cable of being subject to steam sterilization without degradation of the effectiveness of the locking means. Preferably, this material is a tag stock having a weight of at least approximately 175 pounds.

The ends of the invention are also attained by a surgical gown package in which side ties, as above characterized, are joined by a pass card incorporating the features of the invention. The side ties are joined so that the gown may be folded to a compact package which may be steamed sterilized and then made available to be put on in accordance with accepted sterile techniques.

The above and other related objects and features of the invention will be apparent from a reading of the following description of a preferred embodiment of the invention, with the novelty thereof pointed in the appended claims.

Figure 1:
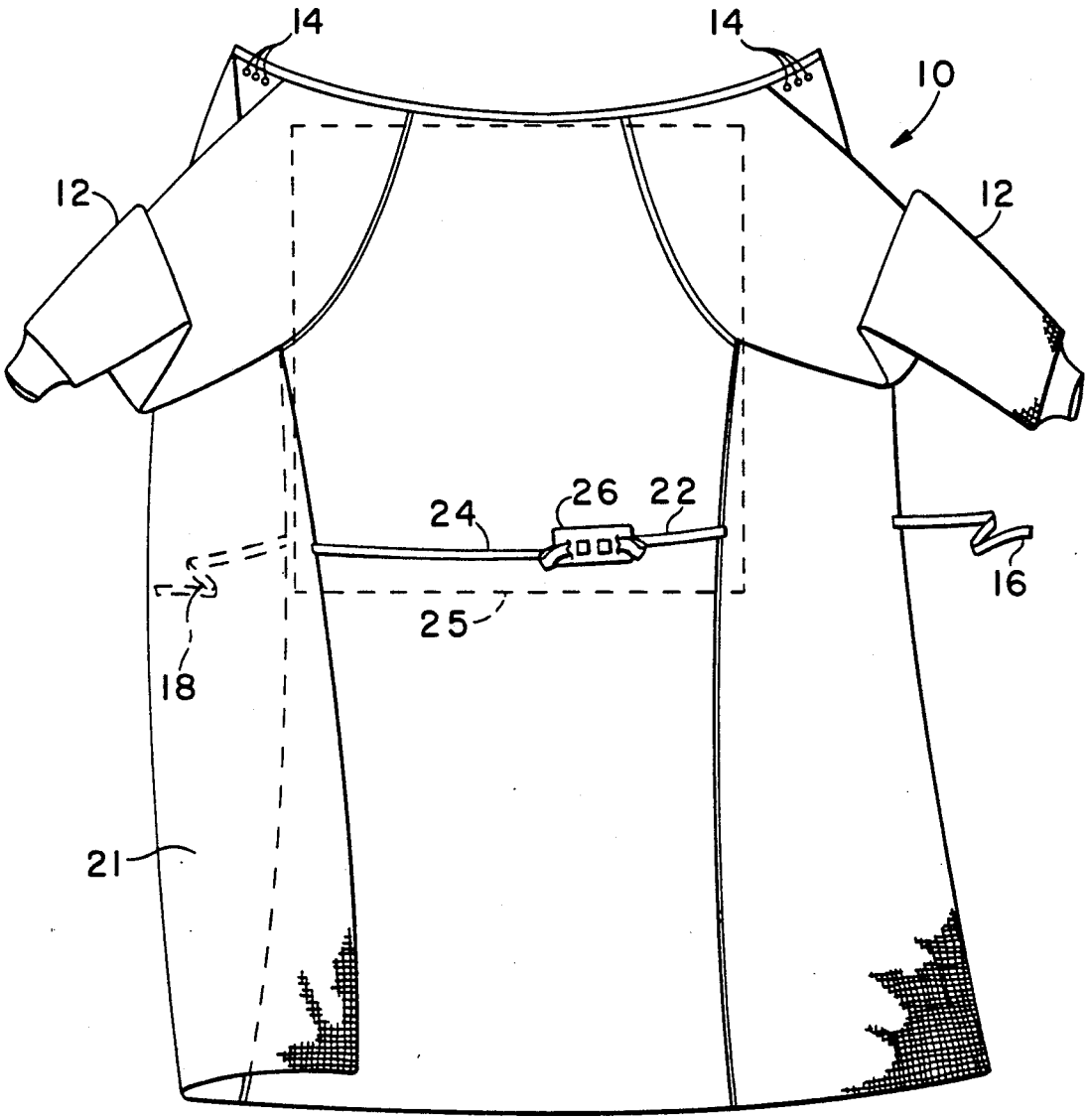
FIG. 1 is a plan view of a surgical gown with its side ties secured by a pass card embodying the present invention.
Figure 2:
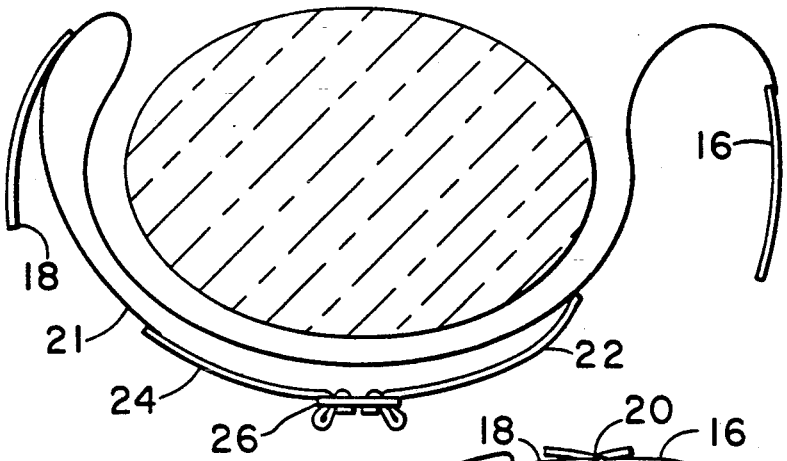
FIGS. 2, 3, 4 and 5 are schematic sections, taken generally at the waist of a wearer, illustrating the manner in which the surgical gown would be secured on the wearer and the function of the pass card in this process.

FIG. 1 shows a surgical gown, indicated by reference character 10, which is generally in the form of a wrap around garment with sleeves 12 being provided for insertion of a wearer's arms. In use, rafter insertion of the arms into the sleeves 12, the upper end of the gown is wrapped around the wearer's neck and secured by snaps 14 (ties could also be used) so that the remainder of the gown is draped on the wearer's body, as indicated in FIG. 2, wherein the waist is indicated in section by phantom lines.

Figure 3:
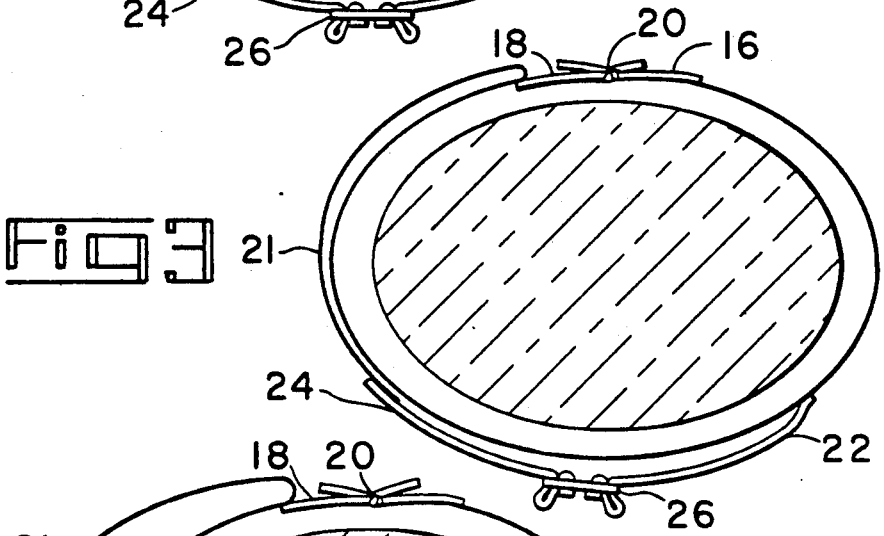

The next step in putting on the gown is to provide an initial encirclement of the wearer's body. Back ties 16 and 18 are provided for this purpose. The back ties are, respectively, secured to one side edge of the gown and to the rear, or body side of the gown, in spaced relation from the other side edge. The back ties 16, 18 are manually joined by a knot 20 at the back of the wearer, generally at the height of the waist, as indicated in FIG. 3.

It is of prime importance that all portions of a surgical gown, with which contact is likely to occur, be maintained sterile. The wearer, prior to putting on a surgical gown, will have taken the necessary steps to assure that his hands (usually sterile gloves are worn) are disinfected. Starting with a sterile gown, the wearer is able to insert his hands in the sleeves so that the gown is draped as shown in FIG. 2. At this point, in accordance with accepted sterile techniques, it is assumed that the wearer will be assisted by a person whose is not sterile. That person fastens the neck snaps 14 and secures the back ties 16, 18, The back of the wearer remains as an unsterile area.

To provide a sterile covering for the wearer's back, a flap portion 21 is provided by the portion of the gown lying outwardly of the back tie 18. As will now be explained the flap portion 21 is wrapped around the wearer's back and secured by side ties 22, 24 so that the outer surface of the gown is a sterile area, except for the limited area around the snaps 14 which have been secured by the unsterile assistant. The wearer is thus able to contact other persons similarly dressed in surgical gowns without contaminating his own gown, or hands, the area adjacent the snaps 14 being one that would not be inadvertently contacted.

The front of the surgical gown, extending from the shoulders to just below the waist, is designated as a sterile field. The sterile field is critical in that it faces and is in a direct line with the operating zone where surgical procedures are performed. The sterile field is indicated by broken lines in FIG. 1 and identified by reference character 25.

In attaining the desired end of a sterile outer surface of the gown, particular attention is paid to prevent contamination of the sterile field 25, side ties 22, 24 and the wearer's hands. To this end a pass card 26 is provided, with the free ends of the ties 22, 24 being releasably secured, or locked, thereto.

When the gown is initially put on, as indicated in FIG. and when it is preliminarily secured by the ties 16, 18, the pass card 26 maintains these ties adjacent the sterile field 25 of the gown and prevents their contact with unsterile portions of the wearer and minimizes the possibility of their inadvertent contact with unsterile objects.

Figure 4:
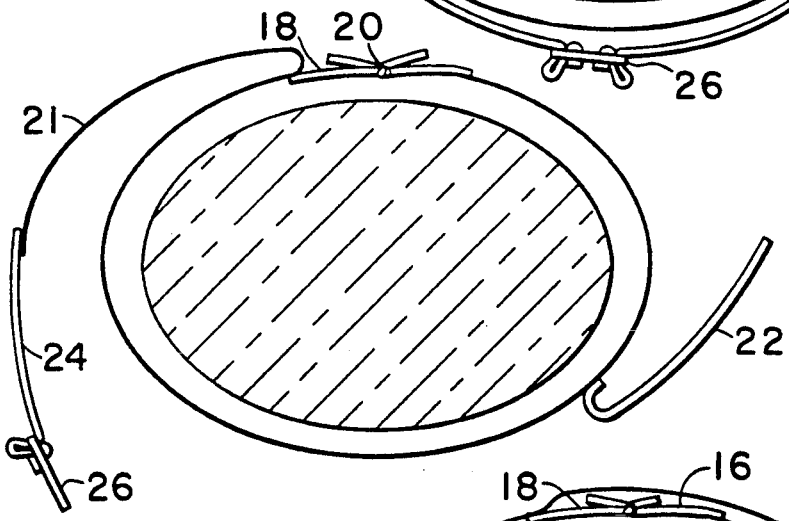
Figure 5:
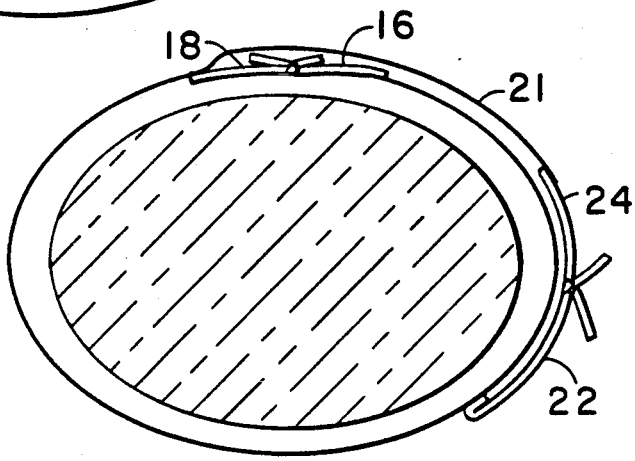

After the gown has been secured by the back ties 16, 18, the wearer releases the side tie 22 from the pass card 26. Then, while the pass card 26 is gripped by the wearer, adjacent the tie 24, an assistant grips the outer end of the passes card. The wearer then releases the pass card and the assistant, holding only the outer end of the pass card, then wraps the flap portion 21 around the wearer's back, as indicated in FIG. 4. The pass card is then positioned so that the wearer may pull the side tie 24 free from the pass card. The wearer, whose hands are gloved and sterile, may then knot the side ties 24, 26 to complete putting on the gown pursuant to accepted sterile techniques.

In accordance with the objects of the invention, the gown is, preferably, fabricated from a light weight, highly flexible, woven polyester fabric characterized by a relatively low coefficient of friction and commonly known as a "slick". The gown material is washable and capable of steam sterilization so that the gown may be reused. This "slick" material because of its low coefficient of friction, has a slippery characteristic which makes it relatively difficult to grip.

Figure 8:
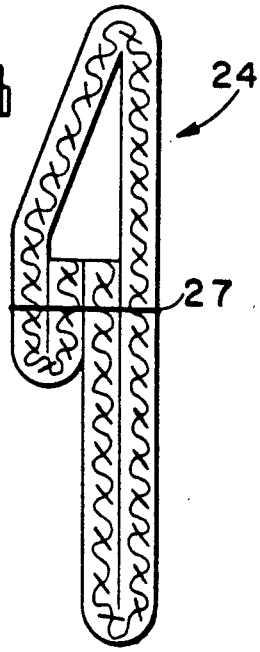
FIG. 8 is a section taken on line 8—8 in FIG. 6 with thicknesses greatly exaggerated.

The side ties 22, 24, in accordance with standard fabrication techniques, each comprise a flattened tubular sleeve (see FIG. 8) formed from a strip of the same fabric employed in fabricating the gown. The side edges of this strip are folded and secured by lengthwise stitching 27 to prevent fibers from escaping into the atmosphere.

Figure 6:
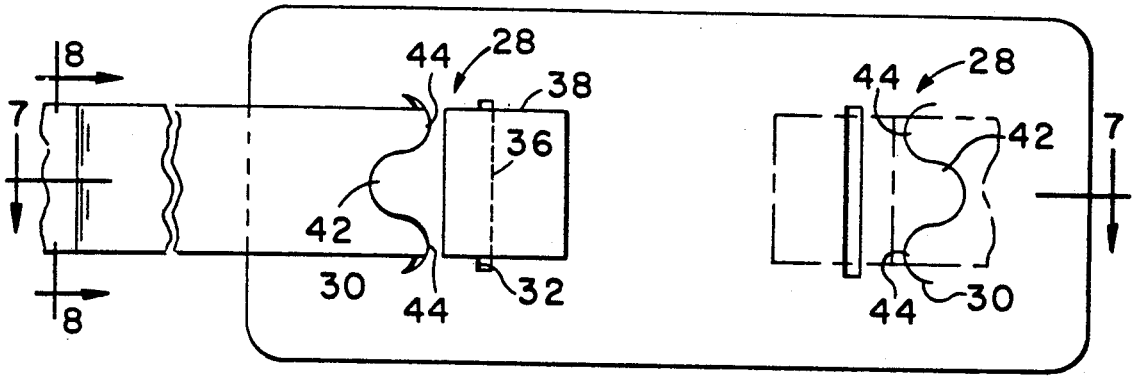
FIG. 6 is an elevation, on an enlarged scale, of the pass card of the present invention.
Figure 7:
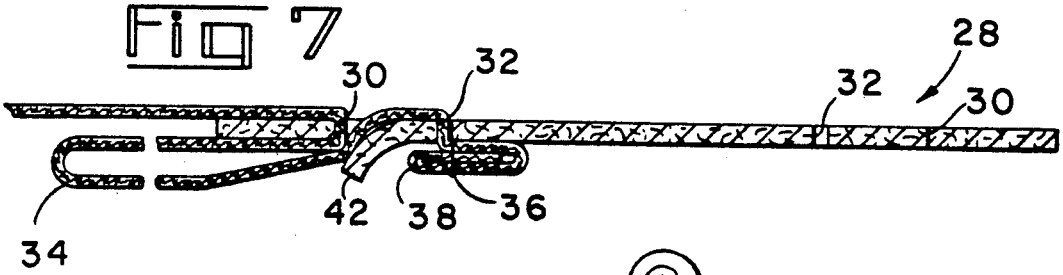
FIG. 7 is a section taken on line 7—7 of FIG. 6, with its thickness and the thickness of the gown tie greatly exaggerated.

The pass card 26, now to be described in detail, is particularly adapted to releasably secure the ties of the referenced type of surgical gown. FIGS. 6 and 7 illustrate the pass card 26 after the tie 22 has been released.

The pass card 26 has a rectangular outline, with a length sufficient for the provision of releasable locking means 28 at its opposite ends, and, further, for it to be grasped by the assistant without contacting the hand of the wearer which is positioning it for transfer. A length of 5½ inches and a width of 3½ inches are preferred dimensions for the pass card.

The releasable locking means 28 each comprise a sinuous slit 30 and a slot 32. Both the slit 30 and the slot 32 have a width somewhat greater than the width of the side ties 22, 24. A loop portion 34 of side tie 24 is projected through the slit 30 from the back side (facing the front surface of the gown) of the pass card 26. The free end of the tie 24 is then passed, from the back side of the pass card 26, through the slot 32. (For the sake of simplicity, the tie 24 is illustrated as having a single thickness of fabric in FIG. 7.)

The free end of the tie 24 comprises folded portions which are hemmed by stitching 36 to form a fabric flap 38. This flap is passed through the slot 32 and then the tie is pulled backward so that the flap 38 engages the outer surface of the pass card 26, as indicated in FIG. 7. In order to facilitate securing the free end of side tie 24, the slot 32 is, preferably, formed as a cut out slot having a length of approximately 1/8 inch in order to accommodate the thickness of the hemmed end of the tie.

The free end of the side tie 22 is releasably secured in the slit 30 and slot 32 at the opposite end of the pass card 26 in the same fashion as described in connection with the tie 24.

The sinuous slits 30 provide a unique slipable locking, or gripping, function which provides for adjustment of the effective length of the side ties 22, 24 to accommodate the girth of the wearer. This locking function is attained through deflection of the tongues 42, 44 from the plane of the card.

As indicated above, it is desired that the ties 22, 24 remain generally registered with the sterile field 25, at the waist of the wearer. The length of the loops 34 are such that this end is attained when the gown is put on and preliminarily secured by the back ties 16, 18 (FIG. 3) on an average of relatively small girth. If the wearer has a relatively large girth, one or both of the ties 22, 24 will slip in the slits 30, thereby increasing the effective length of the ties to accommodate the girth of the wearer. For either a slender wearer, or a heavier wearer, the pass card 26 and the side ties are automatically maintained in the desired relation to the sterile field 25.

The locking, or gripping, function of the slots 32 is more positive. A relatively strong force, or pull, is required to cause the flap 38 to fold and deflect the card material so that the enlarged, hemmed end of tie may be drawn therethrough to release the tie from the pass card. Thus, the securing means provides that tie will not be inadvertently released from the pass card 26 when they slip in the slits 30 to adjust to the girth of a given wearer.

It will again be noted that the present invention is directed to the provision of pass cards that are to be used with reusable surgical gowns. That is, after use, the gowns are washed. The gowns are then laid flat and the ends of the ties 22, 24 attached to pass card 26, as above described. Each gown is then folded so that the sterile field 25 is disposed within the inner layers of a compact package. This folded, gown package is then banded, so that it will not unfold. The gown package is then exposed to a steam atmosphere to sterilize the gown.

It has been found that the ends of the present invention are preferably attained by the use of a pass card formed of 175 pound white, tag stock. More specifically, "tag stock" designates a sulfite or sulfate or a mixture of sulfite/sulfate papers as used for file folders, warehouse tags, etc., and known such in the trade. The weight of 175 pounds relates to the weight of 500 sheets of 24 by 36 inch sheets of this material. A weight of 175 pounds has been found to be the approximate minimum weight suitable to provide the desired locking functions. The term "white" material designates that the tag material is free of dyes which might be transferred to the gown in the steam serialization process.

The card material, in combination with the sinuous configuration of the slits has been found particularly effective in providing the desired slipable gripping function, again referencing the steam sterilization procedure. Thus, attention is directed to the fact that the sinuous slit 30 defines an outwardly directed curved tongue 42 overlying the tie (22 or 24) and a pair of inwardly directed tabs 44 underlying the tie (22 or 24).

For purposes of the present invention, the gown 10, with the pass card 26 attached, as illustrated in FIG. 1 is considered as a "package" which facilitates the gown to be put on in accordance with accepted sterile techniques. The term "package" would also include the more conventional use of that term to reference the above described folding of the gown to a compact, banded bundle.

While the above described pass card and its relationship to a surgical gown is preferred, equivalent configurations of the pass card and other materials for the pass card will occur to those skilled in the art within the spirit and scope of the present invention as set forth in the following claims.

Having described the invention, what is claimed as novel and desired to be secured by Letters Patent of the United States is:

1. A pass card employed in packaging reusable surgical gowns in a manner facilitating their being put on in accordance with accepted sterile techniques, such gowns being fabricated of a light weight, woven fabric, characterized by a relatively low coefficient of friction, and having side ties, formed of the same fabric, having a given width and at least one of said side ties having a multiple layer, hemmed, terminal end, said pass card comprising a relatively thin, rectangular card having selectively releasable locking means for engagement with the end portions of at least on of the side ties, said card having a length sufficient for the card to be gripped by two persons without contact between their hands, said releasable locking means being characterized by a slot spaced inwardly from one end of the card and having a width approximating and at least as great as the width of the side ties, said slot having a length less than the thickness of the hemmed ends of the side ties and being adapted for the hemmed, terminal end of one of the side ties to be passed therethrough and further characterized in that said slot is adapted to cooperate with said hemmed end to present inadvertent disengagement of the card from the tie and selectively permit such disengagement solely in response to a relatively strong pull.

2. A pass card as in claim 1 wherein the releasable locking means is further characterized by a slit disposed generally parallel to said slot, spaced therefrom and having a width approximately the width of the side ties, said slit being adapted to receive a loop formed in said one side tie, inwardly of its hemmed terminal end, and providing a locking action, derived from deflection of the card material, requiring a relatively small force to withdraw the loop portion from the slit.

3. A pass card as in claim 2 further characterized in that said slot is disposed adjacent one end of said card, and said slot is disposed between said slot and said one end of said card.

4. A pass card as in claim 3 further characterized in that the slit defines a central tongue projecting towards said one end of the card and adapted to overlie said loop.

5. A pass card as in claim 4 further characterized in that said slit is sinuous and defines inwardly projecting tabs, on opposite sides of the outwardly projecting tab, which are adapted to underlie the side tie loop.

6. A pass card as in claim 4 further characterized in that said slot is a cut slot having a finite length.

7. A pass card as in claim 6 further characterized in that the card is formed of a material capable of being subject to steam sterilization without degradation of the effectiveness of the locking means.

8. A pass card as in claim 7 further characterized in that the card material is tag stock having a weight of at least, approximately, 175 pounds.

9. A pass card as in claim 4 adapted for use with a surgical gown wherein both side ties have multiple layer, hemmed terminal ends and further characterized by the locking means at the other end of the card, comprising a second slot spaced inwardly from said other end of the card and a second slit disposed between the second slot and said other end of the card, said second slot being adapted for the hemmed, terminal end of the other of the side ties to be passed therethrough and provide a locking action requiring a relatively strong pull to release, and said second slot being adapted to receive a loop formed in said other side tie, inwardly of its hemmed terminal end, and providing a locking action, derived from deflection of the card material, requiring a relatively small force to withdraw the loop portion from the slit, and further characterized in that the second slit defines a central tongue projecting toward said other end of the card and adapted to overlay the loop in the other side tie.

10. A pass card as in claim 9 further characterized in that said slits are sinuous and define inwardly projecting tabs, on opposite sides of the outwardly projecting tabs, which are adapted to underlie the side tie loops, and the card is formed of white tag stock having a weight of at least, approximately, 175 pounds, capable of being subject to steam sterilization without degradation of the effectiveness of the locking means, and the card has a length of approximately 5½ inches and a width of approximately 3½ inches and each slot has a length of approximately 1/8 inch.

11. A reusable surgical gown package facilitating a surgical gown to be put on in accordance with accepted sterile techniques, wherein the surgical gown is a wrap around gown fabricated of a light weight, woven fabric, characterized by a relatively low coefficient of friction, said gown has side ties, formed of the said fabric, one of said side ties being secured to the front surface of the gown and spaced inwardly from one side edge thereof and the other of said side ties being secured to a flap portion extending inwardly of the other side edge thereof, said gown having on its outer, front surface, a sterile field extending from a shoulder portion to the waist portion thereof, with the side ties being folded in overlying reaction on said sterile field, at least one side tie being characterized that its terminal end is formed by multiple layers of hemmed fabric, and further comprising a relatively thin pass card to which the terminal ends of the side ties are releasably secured, said pass card comprising a rectangular card having selectively releasable locking means, engaging the end portion of at least one of the side ties, said card having a length sufficient for the card to be gripped by two persons without contact between their hands, said releasable locking means being characterized by a slot disposed wholly within the outline of the pass card and spaced inwardly from one end of the card and having a width approximating and at least as great as the width of said one side tie, and further characterize in that the terminal end of the one side tie is inserted through said slot and the slot and terminal end cooperate to prevent inadvertent disengagement of the card from said one tie and selectively permit such disengagement solely in response to a relatively strong pull.

12. A reusable surgical gown package as in claim 11 further characterized by the releasable locking means further comprising a slit disposed generally parallel to said slot, spaced therefrom and having a width approximately the width of the one side tie, and said one side tie having a loop formed therein and inserted through said slit, said loop deflecting the card material defining said slit to provide a locking action requiring a relatively small force to withdraw the loop portion from the slit.

13. A surgical gown package as in claim 12 further characterized in that said slot is disposed adjacent one end of said card and said slot is disposed between said slot and said one end of said card.

14. A surgical gown package as in claim 13 further characterized in that said slit defines a central tongue projecting towards said one end of the card and overlying said loop.

15. A surgical gown package as in claim 14 wherein the gown material is a woven polyester fabric, known as a "slick", further characterized in that said slit is sinuous and defines inwardly projecting tabs, on opposite sides of the outwardly projecting tab, which underlie the side tie loop.

16. A surgical gown package as in claim 15 further characterized in that the hemmed end of said gown tie has an inwardly projecting fabric tab of folded fabric, and further characterized in that said slot is a cut slot having a finite length and the terminal end of said one side tie engages the surface of the card to one side of the slot and the fabric tab engages the surface of the card to the other side of the slot.

17. A surgical gown package as in claim 15 further characterized in that the card is formed of a material capable of being subject to steam sterilization without degradation of the effectiveness of the locking means.

18. A surgical gown package as in claim 17 further characterized in that the card material is tag stock having a weight of at least, approximately, 175 pounds.

19. A surgical gown package as in claim 14 wherein the surgical gown is fabricated from a woven polyester fabric, known as a "slick", and further characterized by both side ties having at their terminal ends formed by multiple layers of hemmed fabric, and further characterized in that the locking means at the other end of the card comprises a second slot spaced inwardly from said other end of the card and a second slit disposed between the second slot and said other end of the card, said second slot being adapted for the hemmed, terminal end of the other of the side ties to be passed therethrough and provide a locking action requiring a relatively strong pull to release, and said second slot being adapted to receive a loop formed in said other side tie, inwardly of its hemmed terminal end, and providing a locking action, derived from deflection of the card material, requiring a relatively small force to withdraw the loop portion from the slit, and further characterized in that the second slit defines a central tongue projecting toward said other end of the card and adapted to overlay the loop in the other side tie.

20. A surgical gown package as in claim 19 further characterized in that said slits are sinuous and define inwardly projecting tabs, on opposite sides of the outwardly projecting tabs, which underlie the side tie loops, and the card is formed of white tag stock having a weight of at least, approximately, 175 pounds, capable of being subject to steam sterilization without degradation of the effectiveness of the locking means, and the card has a length of approximately 5½ inches and a width of approximately 3½ inches and each slot has a length of approximately 1/8 inch.

21. A reusable, surgical gown in the form of a wrap around gown fabricated of a light weight, woven fabric, characterized by a relatively low coefficient of friction, and having, and having side ties, formed of said fabric, one of said side ties being secured to the front surface of the gown and spaced inwardly from one side edge thereof and the other of said side ties being secured to a flap portion extending inwardly of the other side edge thereof, characterized in that one of said side ties has hemmed multiple layers at its terminal end, which is adapted to be inserted through a slot formed in a pass card and cooperate with the slot to prevent inadvertent disengagement of the card from said one tie and selectively permit such disengagement solely in response to a relatively strong pull.

22. A reusable surgical gown as in claim 21 further characterized in that the gown material is a woven polyester fabric, commonly known as a "slick", the other side tie has hemmed multiple layers at its terminal ends, which are adapted to be inserted through a second slot formed in the pass card and cooperate with the second slot to prevent inadvertent disengagement of the card from said other tie and selectively permit such disengagement solely in response to a relatively strong pull.

23. A reusable gown as in claim 22 further characterized in that the multiple layers, at the terminal ends of the side ties, form inwardly directed fabric tabs which enhance the effectiveness of their being releasably locked on the pass card.

24. A reusable gown as in claim 22 further characterized in that each side ties is formed from a flattened tube comprising a strip of said woven material, longitudinally seamed to dispose the side edges thereof interiorly of said tube.

* * * * *